US009805594B2

(12) United States Patent
Buchholz et al.

(10) Patent No.: US 9,805,594 B2
(45) Date of Patent: Oct. 31, 2017

(54) METHOD, EVALUATION SYSTEM AND VEHICLE FOR PREDICTING AT LEAST ONE CONGESTION PARAMETER

(71) Applicants: AUDI AG, Ingolstadt (DE); VOLKSWAGEN AG, Wolfsburg (DE)

(72) Inventors: Jan Buchholz, Ergolding (DE); Stephan Lorenz, Munich (DE); Tilman Lacko, Braunschweig (DE)

(73) Assignees: Audi AG, Ingolstadt (DE); Volkswagen AG, Wolfsburg (DE)

( * ) Notice: Subject to any disclaimer, the term of this patent is extended or adjusted under 35 U.S.C. 154(b) by 0 days.

(21) Appl. No.: 14/917,159

(22) PCT Filed: Sep. 4, 2014

(86) PCT No.: PCT/EP2014/002401

§ 371 (c)(1),
(2) Date: Mar. 7, 2016

(87) PCT Pub. No.: WO2015/032499

PCT Pub. Date: Mar. 12, 2015

(65) Prior Publication Data

US 2016/0210852 A1 Jul. 21, 2016

(30) Foreign Application Priority Data

Sep. 6, 2013 (DE) ..... 10 2013 014 872

(51) Int. Cl.
*G08G 1/01* (2006.01)

(52) U.S. Cl.
CPC ..... *G08G 1/0133* (2013.01); *G08G 1/0112* (2013.01); *G08G 1/0129* (2013.01); *G08G 1/0141* (2013.01)

(58) Field of Classification Search
CPC .. G08G 1/0112; G08G 1/0129; G08G 1/0133; G08G 1/0141

(Continued)

(56) References Cited

U.S. PATENT DOCUMENTS

2002/0045985 A1 4/2002 Kerner
2004/0039517 A1 2/2004 Biesinger et al.

(Continued)

FOREIGN PATENT DOCUMENTS

CN 101290713 A 10/2008
CN 101325004 A 12/2008

(Continued)

OTHER PUBLICATIONS

Office Action from corresponding Chinese Patent Application No. 201480045735.4 dated Sep. 5, 2016.

(Continued)

*Primary Examiner* — Ojiako Nwugo
(74) *Attorney, Agent, or Firm* — Alston & Bird LLP

(57) ABSTRACT

A method, an evaluation system and a cooperative vehicle for predicting at least one congestion parameter are proposed. The method involves a detecting of a traffic density 71-74, a detecting of a current position x which is present during the detecting of the traffic density 71-74 and a relaying of the traffic density 71-74 and the current position x to an evaluation unit 60. Moreover, the method includes an evaluation of the traffic density 71-74 and a providing of at least one congestion parameter.

10 Claims, 2 Drawing Sheets

Figure 1:
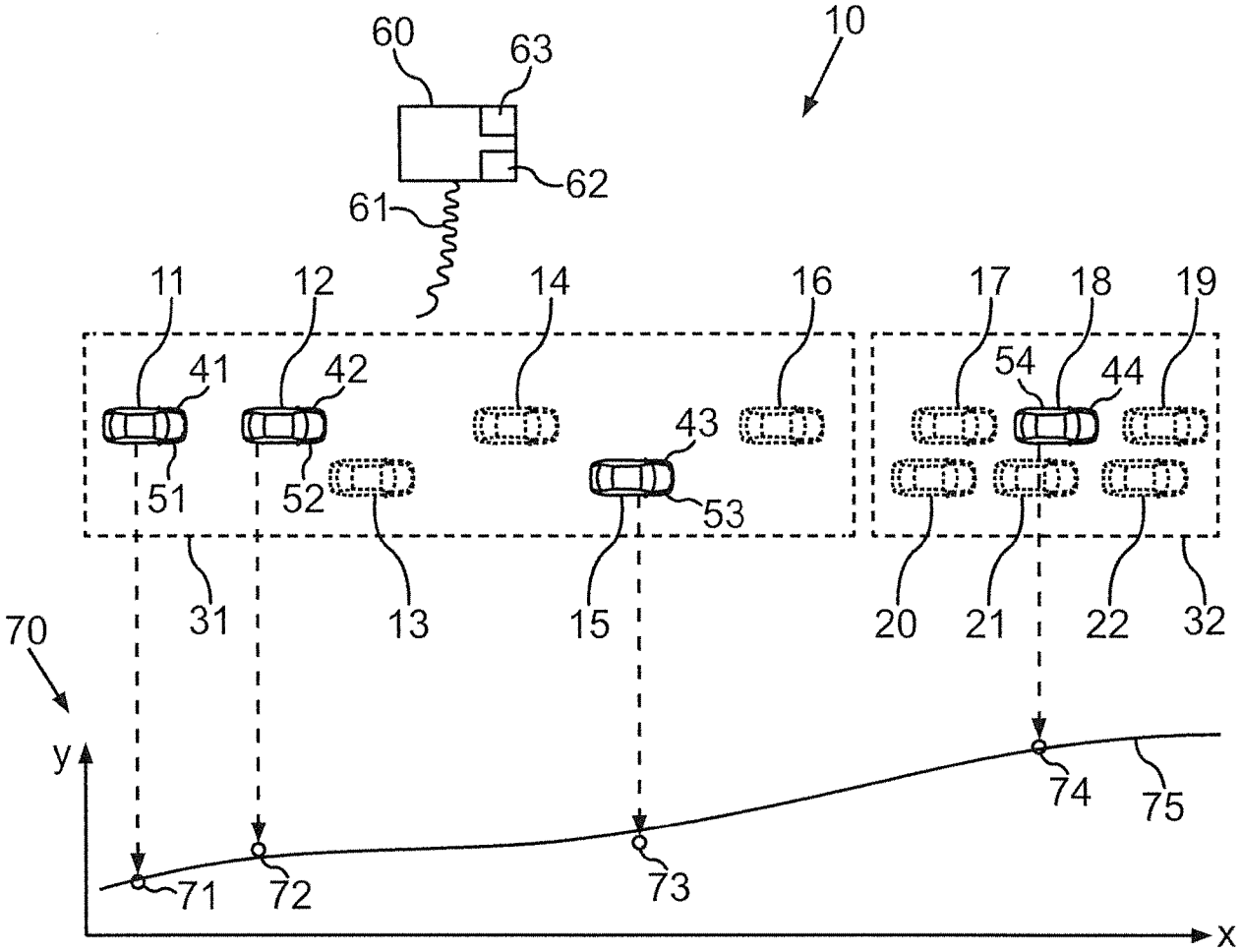

(58) Field of Classification Search
USPC ..... 340/934, 439, 933, 939; 701/117, 118
See application file for complete search history.

(56) References Cited

U.S. PATENT DOCUMENTS

| | | | | |
|---|---|---|---|---|
| 2010/0015963 | A1 | 1/2010 | Hesse et al. | |
| 2010/0082227 | A1* | 4/2010 | Posner | G08G 1/096775 701/118 |

FOREIGN PATENT DOCUMENTS

| | | | | |
|---|---|---|---|---|
| CN | 101694743 | A | 4/2010 | |
| DE | 10 036789 | A1 | 2/2002 | |
| DE | 10 057796 | A1 | 5/2002 | |
| DE | 10 062856 | A1 | 6/2002 | |
| DE | 10 063763 | A1 | 7/2002 | |
| DE | 10 2006 001354 | A1 | 7/2007 | |
| DE | 10 2006 004130 | A1 | 8/2007 | |
| DE | 10 2007 050154 | A1 | 4/2009 | |
| DE | 102008003039 | A1 | 7/2009 | |
| DE | 102009008745 | A1 | 8/2010 | |
| DE | 10 2009 029531 | A1 | 3/2011 | |
| DE | 10 2012 009822 | A1 | 11/2012 | |
| DE | 102012009822 | * | 11/2012 | G08G 1/01 |
| DE | 10 2011 083677 | A1 | 4/2013 | |
| EP | 0 908 861 | A2 | 4/1999 | |
| EP | 1 657 693 | A2 | 5/2006 | |

OTHER PUBLICATIONS

International Search Report and Written Opinion for Application No. PCT/EP2014/002401 dated Nov. 27, 2014.
International Preliminary Report on Patentability Chapter II for Application No. PCT/EP2014/002401 dated Nov. 26, 2015.

* cited by examiner

METHOD, EVALUATION SYSTEM AND VEHICLE FOR PREDICTING AT LEAST ONE CONGESTION PARAMETER

CROSS REFERENCE TO RELATED APPLICATIONS

This application is a national stage 371 application of International Application No. PCT/EP2014/002401 filed Sep. 4, 2014, which claims priority to and the benefit of German Application No. 102013014872.3, filed Sep. 6, 2013, the entire contents of which are hereby incorporated by reference.

The invention concerns the field of automotive engineering and proposes a method, an evaluation system and a cooperative vehicle for predicting at least one congestion parameter.

DE 10 2008 003 039 A1 describes a method for identification of traffic conditions on the basis of measurement data, wherein the measurement data is obtained in a vehicle. One detects the speed of the vehicle, the distances and relative speeds of other vehicles around the vehicle, in order to perform a traffic condition identification in the vehicle itself.

Moreover, systems for identification of traffic jams in the highway network are known, in which position and movement data of networked vehicles is used. This uses a backend-based system architecture, such as a server within a communication network, and movement profiles of the networked vehicles. The principle of the networked vehicle is also known as Floating Car Data (=FCD). Besides the current positions of congestion start and congestion end, additional values can be ascertained, such as the speed within the congestion or the type of traffic flow. The obtained information can be distributed to other vehicles via an online service by mobile radio technology. This providing of information makes it possible for networked vehicles to generate a telematic road preview and obtain knowledge of circumstances which are thus far not identifiable with a local perception of the surroundings. An important factor for the usefulness of the information is the accuracy of the position of the congestion start and the congestion end, since these positions directly affect the quality of the congestion prediction and functions dependent on it.

An observation of congestion ends over a lengthy course of time makes it possible to predict the development of the congestion end and allows an estimation of additional propagation parameters, such as speed and direction, in which the congestion end further develops over the course of time. This means that the development is continued to the extent that one not only ascertains the presence of a congestion, but also dynamic parameters of the congestion, such as its speed and the location of the congestion start at a given time. An exact prediction of the developing congestion situation is relevant for the further planning of a traffic route. For a vehicle present in a traffic flow the time of arrival at the congestion plays a greater role that the time of detection of the congestion end in the backend architecture. However, thus far the predictions are inaccurate at predicting a time of arrival at a congestion end.

Therefore, the invention proposes a solution for the problem of how to provide more precise congestion parameters.

The problem is solved with a method for predicting of at least one congestion parameter. The method calls for detecting a traffic density, detecting a current position which is present during the detecting the traffic density and relaying the traffic density and the current position to an evaluation unit. Moreover, the method includes an evaluation of the traffic density and a providing of at least one congestion parameter.

Moreover, the problem of the present invention is solved with an evaluation system for predicting of at least one congestion parameter. The evaluation system has an evaluation unit for evaluating a traffic density. Moreover, the evaluation system has a transmission link to at least one cooperative vehicle in an approach zone of a traffic jam and one reception unit for receiving the traffic density and a current position of the cooperative vehicle, wherein the current position of the cooperative vehicle is present during the detection of the traffic density. With the evaluation unit, the traffic density can be evaluated. Moreover, with the evaluation unit at least one congestion parameter can be provided.

The problem of the invention is also solved with a cooperative vehicle for providing of a traffic density for a predicting of at least one congestion parameter. The cooperative vehicle has at least one transmission link to an evaluation unit and one detection unit for detecting of traffic density. Moreover, the cooperative vehicle has a detection unit for detecting the current position which is present during the detection of the traffic density. Furthermore, the cooperative vehicle has a transmission unit for relaying the traffic density and the current position via the transmission link to the evaluation unit.

Further benefits will emerge from the subclaims, which have been formulated for a method, while the corresponding features also hold for the evaluation system according to the invention and the vehicle according to the invention.

The invention starts from a predicting of at least one congestion parameter, during which a traffic density is evaluated. By a traffic density is meant a number of vehicles per distance. For the recording of a traffic density, one can use vehicles which are outfitted as cooperative vehicles. Such cooperative vehicles have recording systems to locate other vehicles present in the surroundings. The recording systems used can be, for example, cameras, such as a front camera, a rear camera or a pivoting camera in or on the vehicle. Moreover, radar systems can also be used.

The cooperative vehicles can contain radio links to other cooperative vehicles. Moreover, the cooperative vehicles contain a radio contact with permanently installed facilities, such as a central evaluation unit or an installed sign gantry, which gathers and relays the traffic data. A cooperative vehicle can ascertain both the distance from other neighboring vehicles as well as their speed. By neighboring vehicles is meant moving or parked vehicles in the surroundings of the cooperative vehicle. The cooperative vehicle can thus also determine the number of surrounding vehicles and in addition their parameters, such as speed, direction of travel, and current position. On the whole, a cooperative vehicle is outfitted with surround sensors, advantageously with a camera, a front radar and/or a tail radar.

The use of a traffic density for the congestion prediction has substantial advantages over currently known method, which use other parameters. In the present case, a true prediction can take place, i.e., a congestion can be predicted in forward-looking manner.

The congestion can advantageously be a position of a congestion start and/or congestion end. These are ascertained congestion parameters which can be determined by a central evaluation unit or by a cooperative vehicle itself. Since cooperative vehicles can also communicate with each other, parameters for a congestion prediction can be gathered from other vehicles and evaluated in one's own vehicle.

However, there are advantages to this task being taken over by a central unit, since this has a better overview and/or more computing power than an individual cooperative vehicle.

For the prediction of at least one congestion parameter, a value [is determined?] by cooperative vehicles, also known as participating vehicles, for the traffic volume or the traffic density by means of weighted parameters, for example, the vehicle's own speed, the number of vehicles which can be detected with surround sensors, the speed of these vehicles and distances from these vehicles, the number of cooperative vehicles, also known as car2x-capable vehicles, in a given area. The more cooperative vehicles taking part in a prediction of a congestion parameter, the more accurate the prediction can be. From one or more of these factors, a traffic density is ascertained in a cooperative vehicle and along with its current position is distributed via a radio link, e.g., by a car2x system, to a central unit as the evaluation system, such as a server, and/or to other cooperative vehicles. Thus, a very accurate traffic density information can be computed at the central unit. Moreover, the cooperative vehicles can get an early picture of the expected traffic volume.

The central unit, such as a server, can bring together all relayed information and has very accurate information about the current traffic flow in a given area. The more vehicles contribute at the same time to an overall traffic density value at a given position x, the higher the quality of these traffic density values. The overall density value is composed of the individual traffic density values that have been relayed by the individual cooperative vehicles to the central unit. It is possible to provide the traffic density values of the individual vehicles with a quality factor, for example, in order to allow for the quality of the relayed information. The quality of the relayed traffic density value of a cooperative vehicle depends, for example, on the detection system used in the cooperative vehicle, the technology stage of the detection system and its model version.

The central unit ascertains from the received traffic density values of the individual cooperative vehicles an approximation function. This approximation function shows the traffic volume over the stretch of road. Based on a digital road map, parameters can be used to correct a congestion prediction. One can further take account of information from on ramps and off ramps, such as highway intersections. The individual routes, i.e., the on ramps and off ramps, take account of the direction of the traffic flow and can be weighted with probabilities.

From the traffic information and the route probabilities when approaching or exiting from the congestion, one can determine the development of the congestion up to the time when the vehicle reaches it.

Advantageously, the detecting of the traffic density is done in an approach zone of a traffic jam. A traffic volume in an approach to a congestion end can be a more important indicator for the further development of the congestion up to the time when the vehicle reaches it. Accordingly, one advantageously ascertains the course of the traffic volume from one's own current position until the congestion end. By one's own position is meant here the position of a cooperative vehicle which would like to prepare for merging with a congestion end. A preparation can occur in the form of a proposal for an alternate route or information as to when a congestion end will be reached.

Moreover, at least one approach parameter can be considered when evaluating the traffic density. An approach parameter is ascertained in an approach zone of a congestion and for example the speed of one's own vehicle and the speed of other vehicles which is still detected even though they are not cooperative vehicles.

Moreover, historical data is considered in the evaluation of the traffic density. A congestion position, i.e., the start and end of a traffic jam, can be predicted by means of the current time variation making use of historical data. The current time variation can be compared with suitable time variations from the past, such as clock time, same day of the week, etc. If the curves agree in the time region covered, one can use the time curve of the past to predict the future development of the congestion. In event of a uniform deviation between the current and the historical data set, the time variation of the current situation can be extrapolated by adding a constant offset, i.e., a constant value, to the historical data set. If there are abrupt, stochastic deviations, one can consider additional traffic information, such as an accident situation, a festivity, etc., and/or use historical expiration times to make a prediction as to the break-up of the traffic jam until the vehicle arrives at the potential congestion end.

Moreover, a weighting of a possible congestion avoidance route with a probability can be present during the evaluation of the traffic density. The calculation of a congestion avoidance route can take into account the intended destination of a vehicle, for example based on historical data or based on an entry in a navigation device. Moreover, on the basis of historical data it can be predicted how many vehicles will possibly use the congestion avoidance route out of habit, without reacting to the actual congestion. This means allowing for the flow of vehicles that would take this route any way and are not affected by the congestion.

A consideration of a quality factor can also be provided in the evaluation of the traffic density. A vehicle-specific quality factor can be considered in the evaluation of the traffic density. To allow for different quality levels of the built-in sensor systems in the cooperative vehicles, a vehicle-specific quality factor can be relayed along with the traffic density value to a central unit, such as a server, and/or other vehicles. In this way, different technical states of the sensors in the vehicles can be taken into account. In other words, a vehicle-specific quality factor can allow for different stages of technology. If at a later time even more precise sensor systems are available, the values of such vehicles could be given a higher priority than the values of vehicles with older or more error-prone systems. In this way, consideration is given to the fact that newer technologies in new vehicles ascertain parameters with a higher measurement precision than older technologies in older vehicles.

In the following, the invention and its modifications will be described with the aid of sample embodiments. The following figures are schematic and not true to scale.

Figure 2:
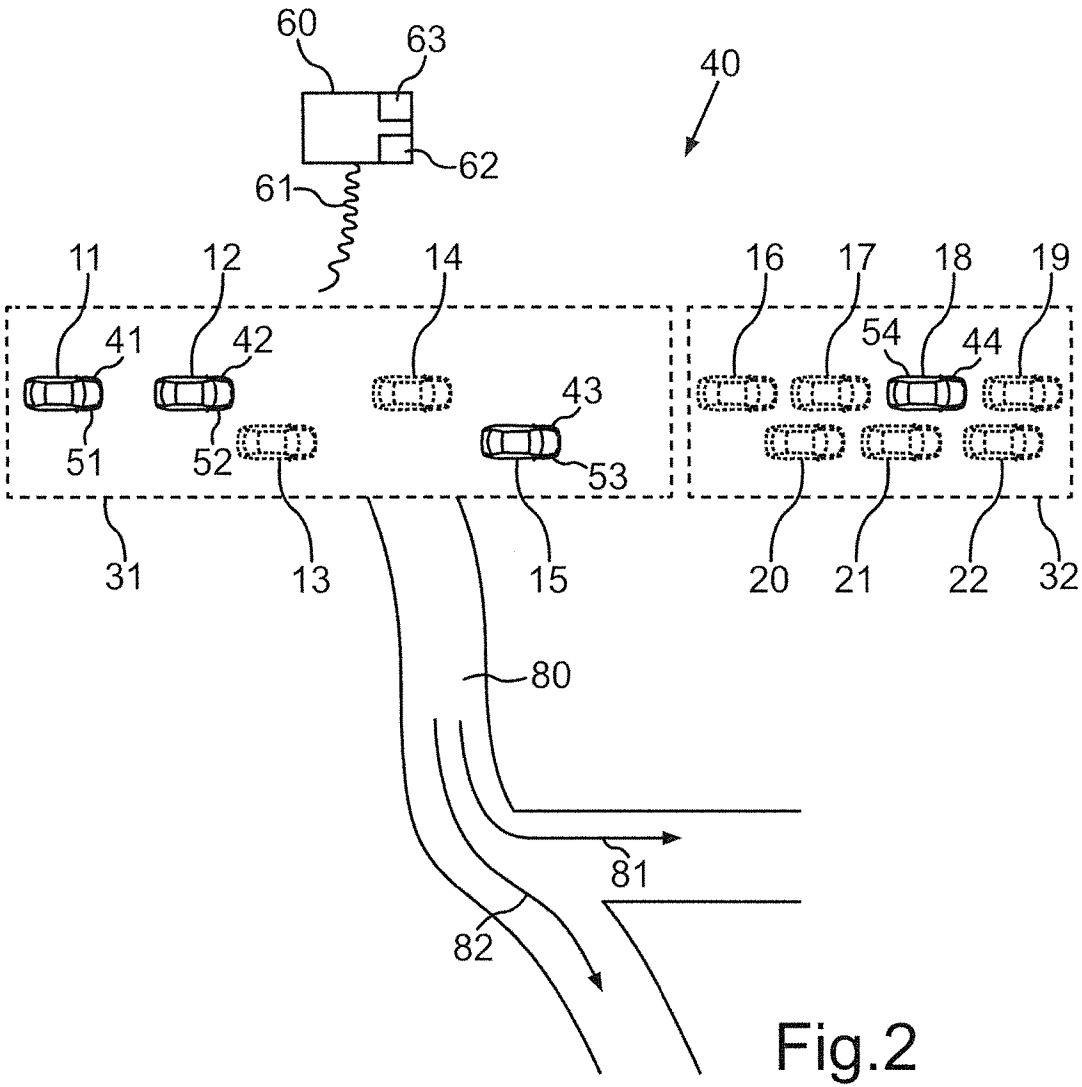

FIG. 1 shows a first sample embodiment with a congestion situation of vehicles, in which a predicting of at least one congestion parameter occurs; and FIG. 2 shows a second sample embodiment with a congestion situation, in which based on a prediction of congestion parameters avoidance routes are proposed to detour around the congestion.

FIG. 1 shows a first congestion situation 10 with a plurality of vehicles 11-22, wherein a first group of vehicles 11-16 is located in an approach zone 31 to the congestion and wherein a second group of vehicles 17-22 is already in a congestion zone 32. The approach zone 31 and the congestion zone 32 are shown schematically. In the approach zone 31 the vehicles 11-16 still have the opportunity to travel at rather high speed, while the vehicles 17-22 in the congestion zone 32 have a speed dictated by the slow advancement of the congestion or the stoppage of the traffic jam. Accordingly, the vehicles 11-16 move much slower than the vehicles 17-22. Now, for the vehicles 11-16 in the approach zone 31 it is of interest to learn something about the upcoming congestion and its parameters. One congestion parameter is, for example, the site of the congestion start.

In the present example, a sample method for predicting of congestion parameters is described from the viewpoint of vehicle 11. Vehicle 11, as well as vehicles 12, 15 and 18, are configured as cooperative vehicles. This means that they can take part in a method for the predicting of congestion parameters. These vehicles 11, 12, 15, 18 are each outfitted with at least one detection unit 41-44 for the detecting of the traffic density, such as a camera. Moreover, these vehicles 11, 12, 15, 18 are each outfitted with a transmission unit 51-54, which makes it possible to relay the ascertained traffic density and a position of the particular vehicle 11, 12, 15, 18 to a central evaluation unit 60 via a transmission link 61. The central evaluation unit 60 here is configured as a unit in a stationary service center. The service center is operated for example by one or more auto makers and is a service for their customers.

The cooperative vehicles independently of one another detect a traffic density which is present in their current situation on the roadway. At the same time, the cooperative vehicles also detect their current position, since the traffic density is dependent on the position of each individual vehicle. Thus, for example, vehicle 12 detects a different value of a traffic density than does vehicle 18, which already finds itself in the traffic jam. Since the traffic density is defined as vehicles per distance, vehicle 18 ascertains lesser distances from its neighboring vehicles than does vehicle 12. Accordingly, the ascertained traffic density of vehicle 18 is higher than the ascertained traffic density of vehicle 12.

The determination of the traffic density is shown in the enclosed diagram 70 in FIG. 1. Here, the position x or the location x of a vehicle is shown on the x axis, while traffic information is plotted on the y axis. The marked places 71, 72, 73, 74 are the ascertained traffic density values of the vehicles 11, 12, 15, 18. A broken line indicates a correlation between the ascertained traffic densities for the respective vehicles 11, 12, 15, 18. The ascertained traffic views 71-74 of the cooperative vehicles lie on an approximation curve 75, which can be determined centrally by the unit 60 during the evaluation of the traffic densities 71-74. The traffic densities 71-74 result from multiple measurements of an individual vehicle, namely, one measurement each from a neighboring vehicle which is in the view of the camera of the ascertaining vehicle. The distance from the neighboring vehicle is part of the determination. Moreover, a weighting can be done as to whether a neighboring vehicle was ascertained in front of or behind the actual vehicle.

An ascertained traffic density of the actual vehicle takes into account all neighboring vehicles that can be detected with the installed detection systems of the actual vehicle. Thus, the traffic density is a summation of detected vehicles around the vehicle which is ascertaining the traffic density. This ascertained value of the traffic density of an individual vehicle is understood as being traffic density 71-74. Moreover, several ascertained traffic densities of different vehicles can be combined for a location x, for example, by the central unit 60, which gathers individual traffic densities 71-74 from several vehicles displaced in time, with their positions. The summarized value of individual ascertained traffic densities of several vehicles is then an overall value of the traffic densities or an overall traffic density value, which is determined by the central unit 60 and provided to cooperative vehicles directly or indirectly as information.

The ascertained traffic densities 71-74 can be indicated as a relative number, for example in a value range from 0 to 10, where the value 0 means free travel, from value 4 onward there is an approach to a traffic jam, and from value 7 onward there is a congestion situation.

For example, vehicle 11 determines a traffic density of value 4, since it recognizes with its rear camera no other vehicle and with its front camera is recognizes vehicle 12 and vehicle 13. Vehicle 12 ascertains, for example, a traffic density of value 5, since it recognizes with its rear camera the vehicle 11 and with its front camera the two vehicles 14 and 13. Further vehicles in the front direction are concealed by the already recognized vehicles and are not recognized. Vehicle 15, as well as vehicle 12, recognizes for example a traffic density of value 5, since it recognizes with its rear camera vehicle 14 and 13 and with a front camera vehicle 16. Vehicle 15 determines the same traffic density value as vehicle 12, with a detecting of three vehicles in total. Vehicle 18 is already situated in the traffic jam 32 and detects four vehicles, namely, vehicles 17 and 20 with a rear camera and vehicles 19 and 22 with a front camera. Vehicle 21 lies to the side of vehicle 18 and could be detected with a pivoting camera. The vehicle determines a traffic density of value 10, since the distances from the ascertained neighbor vehicles are slight and the speed of vehicle 18 is zero, as it stands in the congestion zone 32 with its neighbor vehicles. If a speed were present for vehicle 18, this could go into the determination of the traffic density, so that a lesser value of 9 would result, for example.

The determination of the traffic density is done in this example in each individual cooperative vehicle and is relayed from the latter each time together with the current vehicle position, for example in the form of GPS data, to the evaluation unit 60 and there received by a detection unit 62 or reception unit 62. The data is gathered here and one or more congestion parameters are evaluated.

After the evaluation of the traffic density information, the evaluation unit 60 can provide by a transmission unit 63 one or more congestion parameters to the cooperative vehicles 11, 12, 15, 18. The congestion parameters here can be the location of the congestion end, the location of the congestion start, the average speed in the approach zone to the congestion 31, the average speed in the actual congestion zone 32 and possible avoidance routes within the congestion approach zone a before reaching the congestion start. The interest in the different congestion parameters can be different for each vehicle. For example, vehicle 11 is interested in whether there is still an avoidance opportunity for an alternative route before reaching the congestion end.

On the other hand, vehicle 18 is interested in where the congestion start is situated and how much time vehicle 18 still needs before it can leave the congestion.

FIG. 2 shows a second sample embodiment with a second congestion situation 40, assuming the traffic volume with the vehicles 11-22 from the first sample embodiment of FIG. 1. FIG. 2 shows a traffic situation succeeding in time the situation of FIG. 1. Here, vehicle 16 has already driven into the congestion and now forms the congestion end in zone 32. The two vehicles 19 and 32 still form the congestion start in zone 32. The cooperative vehicle 15 is still located in the approach zone 31 of the congestion, but cannot take any alternative route, since there is no turn-off for a congestion avoidance route in the forward direction of travel. Now, through the central unit 60, vehicle 15 is warned of the congestion, to prevent it from coming closer to the congestion end at high speed. The central unit 60 relays to vehicle 15 a relative position of the congestion, for example, congestion at 500 meters in relation to the position of vehicle 15. Moreover, the central unit 60 relays to vehicle 15 that it will reach the congestion end in around 11 seconds.

The situation for the cooperative vehicles 11 and 12 differ in FIG. 2 from the situation of the cooperative vehicle 15. For the two vehicles 11, 12 there is still an avoidance opportunity before the congestion. A congestion avoidance route 80 is located in the direction of travel of the two vehicles 11 and 12. The central unit 60 calculates for each of the vehicles 11 and 12, taking into account their destinations, whether the congestion avoidance route 80 is suitable for reaching the desired goal more quickly.

For vehicle 12 the congestion avoidance route 80 is unfavorable, since the central unit 60 has considered historical data in the determination of the traffic density for this congestion avoidance route 80 and a subsequent necessary route 81 for vehicle 12. The central unit 60 comes to the conclusion that, given the present time of day, it is more favorable timewise for vehicle 12 not to use the congestion avoidance route, since a congestion will likewise form on this route with a high probability as in the congestion zone 32, but it is much longer than the traffic jam of the congestion zone 32.

The situation of FIG. 2 is different for vehicle 11 than for vehicle 12. Vehicle 12 has a different destination than 12. Upon proposal of the central unit 60, it can take the congestion avoidance route 80, since there is a different travel route 82 afterwards. This travel route 82 does not lead to a further congestion, as in the case of vehicle 12, but instead to a congestion-free street, which is little traveled at the given time of day. Vehicle 12 could also use this street, but would have to take too many detours requiring longer time than traveling through the congestion of area 32.

On the whole, a more accurate prediction of future congestion positions is possible, since the traffic density is used in judging the traffic situation and its development. The principle of networked vehicles or cooperative vehicles, also called Floating Car Data (=FCD), can be improved with the proposed procedure.

The invention claimed is:

1. A method for predicting at least one congestion parameter, involving detecting a traffic density with a detection unit of a cooperative vehicle;

detecting a current position (x) of the cooperative vehicle which is present during the detecting of the traffic density;

relaying of the traffic density and the current position (x) to an evaluation unit (60);

evaluating the traffic density with the evaluation unit considering a vehicle-specific quality factor; and providing of at least one congestion parameter with the evaluation unit, wherein historical data is considered in the evaluation of the traffic density, wherein a current time variation is compared with historical time variations, and if there is a uniform deviation between the current and the historical data, a time variation of a current situation is extrapolated by adding a constant value to the historical data.

2. The method according to claim 1, wherein the congestion parameter is a position of a congestion start and/or congestion end.

3. The method according to claim 1, wherein the detecting of the traffic density is done in an approach zone of a traffic jam.

4. The method according to claim 1, moreover involving considering of at least one approach parameter in the evaluation of the traffic density.

5. The method according to claim 1, moreover involving weighting of a possible congestion avoidance route with a probability in the evaluation of the traffic density.

6. An evaluation system for predicting of at least one congestion parameter, having a cooperative vehicle for providing a traffic density;

an evaluation unit for evaluating the traffic density; and a transmission link from the cooperative vehicle to the evaluation unit and a transmission link from the evaluation unit to the cooperative vehicle; wherein the cooperative vehicle has a detection unit for detecting of the traffic density and a current position of the cooperative vehicle which is present during the detection of the traffic density, and a transmission unit for relaying the traffic density and the current position (x) via the transmission link to the evaluation unit, wherein the evaluation unit has a reception unit which is designed for receiving the traffic density and the current position (x) of the cooperative vehicle, wherein with the evaluation unit the traffic density is evaluated considering a vehicle-specific quality factor; and with the evaluation unit at least one congestion parameter is provided, wherein the evaluation unit is designed to evaluate the traffic density with the help of historical data, wherein the evaluation unit is further designed to compare a current time variation with historical time variations, wherein if there is a uniform deviation between the current and the historical data the evaluation unit is further designed to extrapolate a time variation of a current situation by adding a constant value to the historical data.

7. The evaluation system according to claim 6, wherein the congestion parameter is a position of a congestion start and/or congestion end.

8. The evaluation system according to claim 6, wherein detecting of the traffic density is done in an approach zone of a traffic jam.

9. The evaluation system according to claim 6, wherein the evaluation unit considers at least one approach parameter in the evaluation of the traffic density.

10. The evaluation system according to claim 6, wherein the evaluation unit is further configured to weigh a possible congestion avoidance route (80) with a probability in the evaluation of the traffic density.

* * * * *